US005106314A

United States Patent [19]

Bael

[11] Patent Number: 5,106,314

[45] Date of Patent: Apr. 21, 1992

[54] SAFETY COVER FOR ELECTRICAL OUTLETS

[76] Inventor: James Bael, 1675 Carr St., Ste. 212, Lakewood, Colo. 80215

[21] Appl. No.: 751,957

[22] Filed: Aug. 29, 1991

[51] Int. Cl.[5] ..... H01R 13/44

[52] U.S. Cl. ..... 439/148; 439/135; 174/67

[58] Field of Search ..... 439/133, 135, 142, 148; 174/67

[56] References Cited

U.S. PATENT DOCUMENTS

| | | | |
|---|---|---|---|
| D. 151,571 | 10/1948 | Tillinghast | 439/148 |
| 2,629,761 | 2/1953 | Determan | 439/148 |
| 2,728,894 | 12/1955 | Peters | 174/67 |
| 2,932,811 | 4/1960 | Abraham | 439/148 |
| 3,131,014 | 4/1964 | Munoz | 439/148 |
| 3,686,616 | 8/1972 | Bowerman | 439/148 |
| 3,811,004 | 5/1974 | Moore | 174/67 |
| 3,876,273 | 4/1975 | Schwartz | 439/148 |
| 3,989,334 | 11/1976 | Fortino | 439/148 |
| 4,293,173 | 10/1981 | Tricca | 439/148 |
| 4,408,813 | 10/1983 | Koehler | 439/148 |
| 4,618,740 | 10/1986 | Ray | 439/148 |
| 4,662,697 | 5/1987 | Moses | 439/148 |
| 4,676,570 | 6/1987 | Pincherri | 439/148 |
| 4,760,215 | 7/1988 | Cook | 174/67 |
| 4,801,271 | 1/1989 | Piper | 439/148 |
| 5,009,610 | 4/1991 | Woskow | 439/148 |

*Primary Examiner*—Paula A. Bradley
*Attorney, Agent, or Firm*—Terry M. Gernstein

[57] ABSTRACT

A safety cover includes a one-piece body having an octagonal central section with two tabs extending outwardly therefrom. The tabs are offset from each other with respect to the central section top and bottom surfaces, and have a thickness that is essentially equal to one-half the thickness of the central section. Each of the tabs has a fastener-receiving hole defined therethrough, and adjacent tabs are coincident when one cover is adjacent to another cover. A fastener extends through the fastener-receiving holes and attaches one or both of the covers to a wall socket. Various fasteners can be used to ensure that unauthorized personnel will not be able to remove a cover from a wall socket once the cover is in place. The cover includes prongs that fit into the socket slots. One form of the cover includes a tear-line between each tab and the body central section.

23 Claims, 2 Drawing Sheets

SAFETY COVER FOR ELECTRICAL OUTLETS

TECHNICAL FIELD OF THE INVENTION

The present invention relates to the general art of electrical outlets, and to the particular field of safety covers for electrical outlets.

BACKGROUND OF THE INVENTION

An electrical outlet or wall socket generally includes a structure-mounted receptacle having a neutral slot and a hot slot in that receptacle. Some wall sockets also include a ground slot as well. These slots are electrically connected to suitable lead lines for phase, neutral and ground connections for connecting electrical equipment to a source of power. A plug generally includes blades that fit into the slots of the wall socket and, some plugs further include a grounding prong that fits into the wall socket ground slot.

Those skilled in the electrical arts have long recognized the dangers and undesirability of inserting an object, other than the suitable plug blades or prongs, into the slots of a wall socket. For this reason, the electrical field includes several designs for safety covers that are intended for semi-permanent attachment to a wall socket to temporarily disable that wall socket by covering the wall socket slots and preventing access thereto by any object A child-proofing cover is an example of such safety covers.

While somewhat successful in achieving their purposes, these safety covers still have drawbacks in several areas.

For example, many of the safety covers are fairly easy to remove once they are in position on the wall socket. Children often quickly learn how to remove the safety cover. Therefore, there is a need for a wall socket safety cover that is "tamper proof" in that once in place, it cannot be easily removed by a child. However, the safety cover should be easy to remove by an authorized individual, such as an adult. Therefore, the requirement of being tamper proof should also include ease of authorized removal.

Another problem with present wall socket safety covers is the inability thereof to adapt to various wall socket configurations. In the event that the wall socket is designed for some special purpose and may have a non-standard configuration of slots, present wall socket safety covers may not be able to cover all unused socket access slots. For example, if the slots are clustered instead of being oriented in line with each other, present safety covers may not be useful. Therefore, there is a need for a wall socket safety cover that is amenable for use in conjunction with a wide variety of wall socket slot configurations, and in conjunction with non-standard wall socket slot arrangements.

Still further, many present wall socket safety covers may be expensive to manufacture, and still are not strong enough to withstand prying or tampering. For example, many present wall socket safety covers have some area of weakness that will break if a child inserts an object between the cover and the wall socket and pries the cover upwardly away from the wall socket. This weak area may give, freeing the wall socket safety cover and providing access to the wall socket slots. Therefore, there is a need for a wall socket safety cover that is not easily pried out of a wall socket slot covering position on the wall socket. On the other hand, such wall socket safety cover should not be so difficult to manufacture as to be too expensive to sell.

Still further, there has been an ever-increasing use of computers and computer-related equipment in the marketplace and at home. This equipment is often plugged into standard NEMA 5-15 or 5-20 duplex (two outlet) wall sockets. This leaves unused outlets in the wall socket. In addition, line conditioners, surge suppressors, outlet strips and UPS's often have unused outlets. When devices that generate electrical impulses (spikes) and noise are plugged into the unused slot, damage, distortion and disruption of operation of the electrical equipment can occur, or the circuit may be overloaded.

Such unused outlets should be covered in a manner that prevents use of the unused outlet for a device that may create such unwanted spikes, surges or transients in the equipment plugged into the other outlet of the socket. Examples of such spike and transient- generating devices include copiers, vacuum cleaners, laser printers, space heaters, paper shredders and the like. Such devices should not be plugged into the same wall socket as a computer, a file server, a modem or the like as such devices may generate a voltage transient or spike that may be undesirably passed to the computer or the like. Therefore, there is a need for a safety cover for a wall socket that can be used in a wall socket that is supporting a computer or computer-related equipment, or other equipment that may be sensitive to electrical surges or transients.

OBJECTS O THE INVENTION

It is a main object of the present invention is to provide a safety cover for a wall socket that can be mounted in a tamper proof manner.

It is another object of the present invention to provide a safety cover for a wall socket that is amenable to accommodating various configurations and combinations of wall socket slots.

It is another object of the present invention to provide a safety cover for a wall socket that is amenable to accommodating non-standard wall socket slot configurations.

It is another object of the present invention to provide a safety cover for a wall socket that is strong yet is efficient and economical to manufacture.

It is another object of the present invention to provide a safety cover for a wall socket that is can be attached to a wall socket in a secure, yet easy manner.

It is a specific object of the present invention to provide a safety cover for a wall socket that is amenable for use on wall sockets that are being used to service sensitive electronic equipment.

It is another specific object of the present invention to provide a safety cover for a wall socket that is amenable for use on wall sockets that are being used to service sensitive electronic equipment, such as computers or other such equipment that may be sensitive to voltage surges or transients.

It is another specific object of the present invention to provide a safety cover for a wall socket that is amenable for use on wall sockets that are being used to service sensitive electronic equipment in which at least one wall socket slot is left unused after all of the sensitive electronic equipment is plugged in.

SUMMARY OF THE INVENTION

These, and other, objects are achieved by a safety cover for use on an electrical wall socket outlet that has a one-piece, monolithic body with tabs extending outwardly of two sides of an octagonal central section of that body. One tab is located adjacent to a top surface of the body central section, and the other tab is located adjacent to a bottom surface of the body central section. The tabs are thus offset from one another.

In the preferred form of the invention, each tab has a thickness equal to one-half of the thickness of the body central section so the tabs can be superimposed one on top of the other when two covers are located adjacent to each other. Each tab has a fastener-receiving hole defined therethrough, and can be fixed to a wall socket by a fastener element extending through the tab hole into a suitable threaded fastener-receiving hole in the wall socket.

One form of the invention includes tearlines between each tab and the body central section edge associated therewith so a tab can be removed from the body central section if desirable. However, the tearlines are strong enough to require grasping the tab and the body central section with tools, such as pliers, to grip the cover with enough force to execute the twisting force necessary to tear the tab off of the body central section. It will not be possible for the gripping tool to be inserted between the body central section and the wall socket when the cover is mounted on the wall socket. Therefore, once the cover is mounted on a wall socket, it is not likely that the cover can be removed by separating a tab from the body central section.

Special fasteners can also be used to attach the cover to a wall socket. The special fasteners can require special tools to remove the cover from the wall socket. If only authorize personnel have such special tools, the tamper proof characteristics of the cover are further enhanced.

With the safety cover of the present invention, the cover can be used singly or in clusters of two or more to accommodate various wall socket slot configurations, and requirements. The octagonal shape of the body central section permits two or more covers to be clustered together within an area of a wall socket. This provides a degree of versatility to the cover of the present invention not available with prior covers. The one-piece nature of the body makes manufacturing this cover efficient, and the tear-off tabs of the alternative form of the cover provides even further versatility to the cover.

BRIEF DESCRIPTION OF THE DRAWING FIGURES

DETAILED DESCRIPTION OF THE PREFERRED EMBODIMENT OF THE INVENTION

Figure 1:
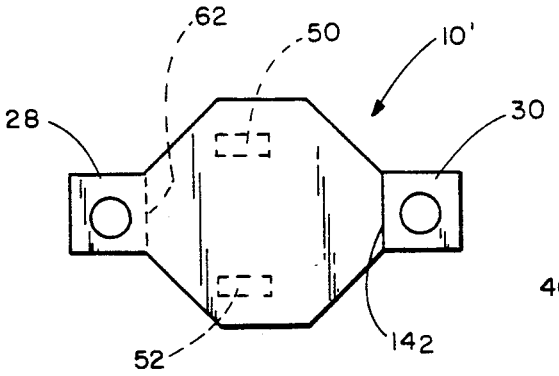
FIG. 1 is a top plan view of a safety cover embodying the present invention.
Figure 2:
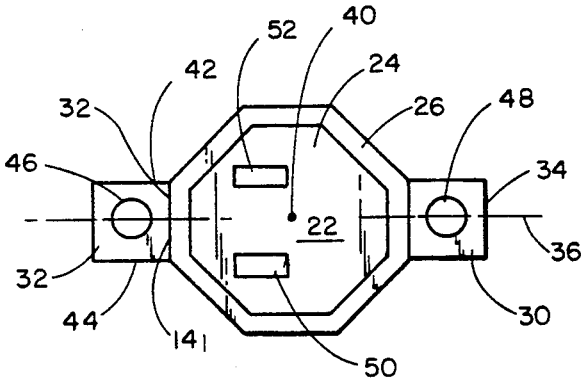
FIG. 2 is a rear view thereof.
Figure 3:
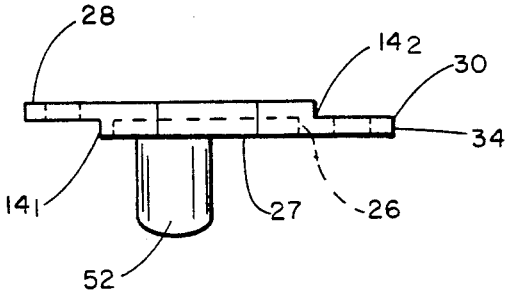
FIG. 3 is a side elevational view thereof.
Figure 4:
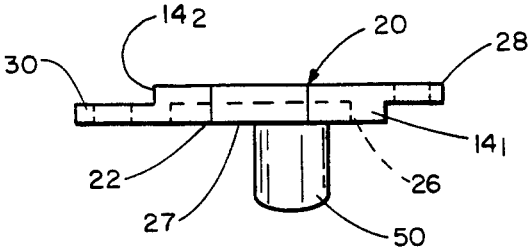
FIG. 4 is a side elevational view thereof showing the side opposite to the side shown in FIG. 3.
Figure 5:
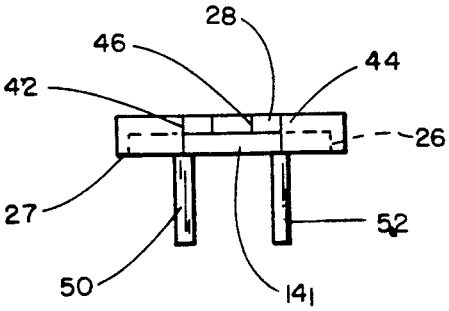
FIG. 5 is an end elevational view thereof.
Figure 6:
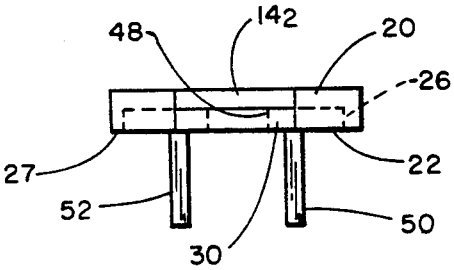
FIG. 6 is an end elevational view thereof showing the end opposite to the end shown in FIG. 5.

Shown in FIGS. 1–6 is a first form of a wall socket safety cover 10 embodying the present invention. The cover 10 is onepiece, preferably plastic material, and includes a central body section 12 that is octagonal in peripheral shape to have eight sides, such as side 14. In the preferred embodiment, all sides 14 are equal in length, as measured between adjacent corners, such as corners 16 and 18. The cover central body section includes a top surface 20 shown in FIG. 1 and a bottom 22 shown in FIG. 2. The top surface is planar, and the bottom includes a recessed portion 24 in the central portion thereof. The recessed portion 24 is surrounded by a wall 26 that is in the shape of the octagonal peripheral outline of the central body section. The wall includes a planar lower rim 27. For the purposes of this application, this lower rim will be considered as the bottom surface of the body central section.

The body 12 further includes first and second tabs, 28 and 30 extending outwardly from an associated side edge of the central body section, such as side edges $\mathbf{14_1}$ and $\mathbf{14_2}$ respectively. Each of the tabs includes a proximal end, such as 15 end 32 of tab 28 connected to the body central section side edge 141, and a distal end, such as end 34 of tab 30 spaced from the body central section side edge associated therewith. Each of the tabs has a longitudinal centerline, such as centerline 36 of tab 30, extending between ends 32 and 34 thereof, with the centerlines of both tabs being collinear with each other and extending through a center 40 of the body. Each tab has two side edges, such as side edges 42 and 44 of tab 28, and has a length dimension measured between the distal and proximal ends thereof and a width dimension measured between the two side edges. In the preferred form of the cover 10, the width dimension of the tabs is essentially equal to the length dimension of the body central section side 14 associated therewith. The body central section side length is measured between adjacent corners, such as corners 16 and 18 on side 14, associated therewith. Also in the preferred form of the cover 10, the length dimension of the tabs is equal to the width dimension thereof so the tabs are square in peripheral shape. Each tab further includes a fastener-receiving hole, such as hole 46 in tab 28 and hole 48 defined in tab 30, defined therethrough. Each fastener-receiving hole is located centrally of the tab.

The cover body central section has a thickness dimension measured between the top surface 20 and the bottom rim 27 of the wall 26 on the bottom 22, and each tab has a thickness dimension measured from the top surface of the tab to the bottom surface of the tab. As is best understood by comparing FIGS. 3 and 4 and FIGS. 5 and 6, one tab has a top surface coplanar with the body central section top surface 20, and the other tab has a bottom surface that is coplanar with the lower rim 27 of the wall 26 on the body central section. The two tabs 28 and 30 are offset from one another along the thickness dimension of the body central section. Each tab has a thickness dimension that is equal to onehalf the thickness dimension of the central body section so that tab 28 of one cover can be superimposed on top of tab 30 of an adjacent cover and the top surfaces of these two adjacent covers, will be coplanar with each other and with the top surface of the tab 28, and the bottom rims 27 of the walls 26 of these two covers will also be coplanar with each other and with the bottom surface of the tab 30.

The cover 10 further includes two wall socket slot engaging prongs 50 and 52 that are attached at one end thereof to the bottom of the body central section and extend away from that bottom. The prongs are sized to fit into a wall socket slot, and are located nearer to tab 28 than to tab 30 to be offset with respect to the body center 40.

Figure 7:
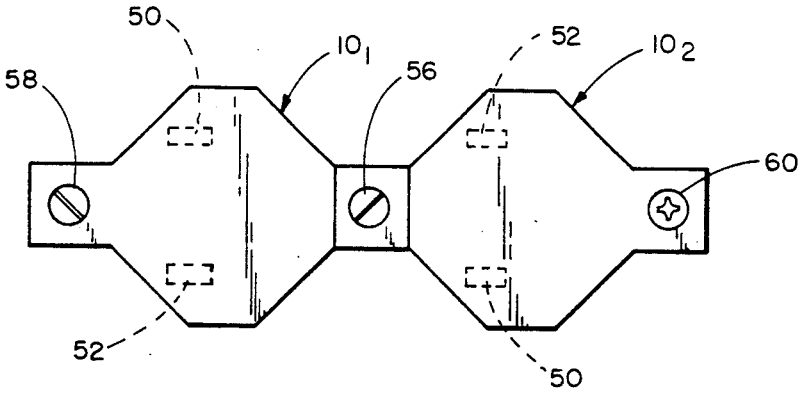
FIG. 7 is a top plan view showing two covers coupled in a straight line configuration.
Figure 8:
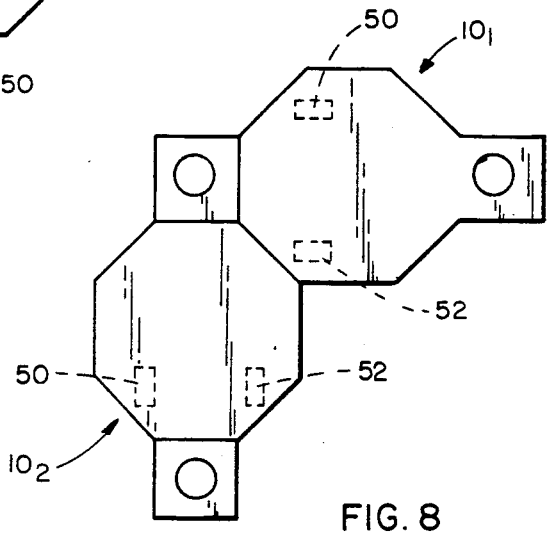
FIG. 8 is a top plan view showing two covers coupled in an angled configuration.

The size, shape and configuration of the cover 10 permits that cover to be combined with other covers in various configurations to accommodate wall socket configurations that may be non-standard. Two examples of such cover combinations are shown in FIGS. 7 and 8. Two covers $\mathbf{10}_1$ and $\mathbf{10}_2$ are combined in a linear arrangement in FIG. 7, and in an angled arrangement in FIG. 8. The linear arrangement has all tab longitudinal centerlines collinear with each other, and the angled arrangement has the tab centerlines of cover $\mathbf{10}_1$ at a right angle with the tab centerlines of cover $\mathbf{10}_2$. The tab 28 of one cover fits on top of tab 30 of the adjacent cover, and the center location of the fastener-receiving holes in those square tabs permits the fastener-receiving hole of tab 28 to be superimposed and coincident with the fastener-receiving hole of tab 30 of the adjacent cover. The square nature of the tabs, and the octagonal shape of the center section of the bodies permits the adjacent covers to be oriented in the various configurations, such as the two configurations shown in FIGS. 7 and 8.

Fasteners, such as slot headed screw 56 shown in FIG. 7, are inserted through the aligned fastener-receiving holes in the coincident tabs and into a fastener-receiving opening in the wall socket. Additional fasteners, such as fastener 58, are inserted through the fastener-receiving holes on the other tabs of the combination to fix the combination to the wall socket by engaging fastener-receiving openings in the wall socket.

The cover is thus securely fixed to a wall socket in any of a wide variety of configurations, and cannot be removed without a special tool. The examples shown in FIGS. 7 and 8 require simple blade screwdrivers; however, special fastener configurations can be used to require special tools that are owned only by authorized personnel can be used to further ensure that the cover, once placed on a wall socket, cannot be removed by unauthorized personnel. Such a special fastener is shown in FIG. 7 as fastener 60, and requires a special star-shaped tool head to remove the fastener from attaching the cover to the wall socket.

Figure 9:
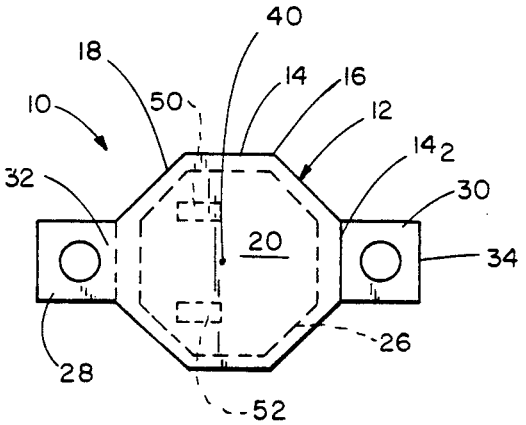
FIG. 9 is a top plan view of a cover having tearlines between each tab and the remainder of the body.
Figure 10:
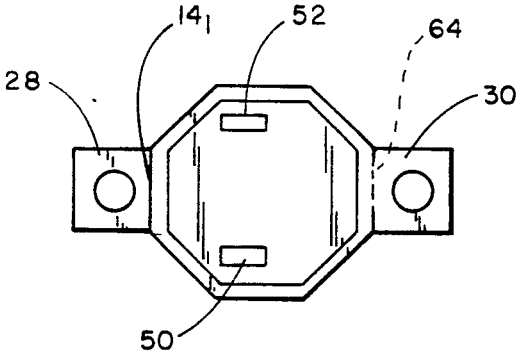
FIG. 10 is a rear view of the cover shown in FIG. 9.
Figure 11:
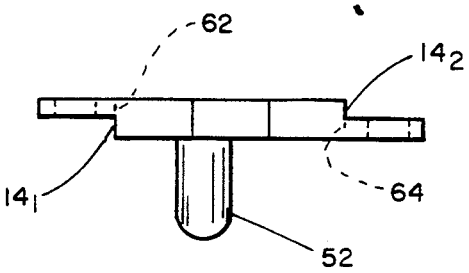
FIG. 11 is a side elevational view of the cover shown in FIG. 9, the side opposite being a mirror image of the side shown in FIG. 11.

Shown in FIGS. 9–11 is a cover 10' that is an alternative form of cover 10 of the present invention. The cover 10' includes tearlines 62 and 64 between tabs 28 and 30 and the body central section side edges $\mathbf{14}_1$ and $\mathbf{14}_2$ respectively. The tearlines 62 and 64 are defined by weakening a portion of the material in the cover, as by scoring or the like, so the tab can be torn off of the body central section The tearlines are weak enough to permit such tab removal, yet are strong enough to require a hand tool, such as pliers, or the like, to produce sufficient twisting force on the tab with respect to the body central section to tear that tab off of the body central section. This will permit an authorized individual to tear a tab off of the body, but will prevent an unauthorized individual from tampering with a cover after that cover is in place on a wall socket. Since pliers or a like tool must be used to grasp the tab while the remainder of the body is held stationary with respect to the grasped tab, once a cover is fastened to a wall socket, it will be extremely difficult to properly hold the tab and the rest of the cover to effect proper twisting motion of the tab with respect to the rest of the body. A child is not likely to have enough manual dexterity to effect such grasping and twisting motions, especially if the cover is in place on a wall socket.

It is understood that while certain forms of the present invention have been illustrated and described herein, it is not to be limited to the specific forms or arrangements of parts described and shown.

I claim:

1. A safety cover for use on an electrical wall outlet switch comprising:

a one-piece body having a central section that includes a plurality of sides, a top surface, and a bottom surface, a first tab extending outwardly from one side of said central section sides and having a top surface that is essentially coplanar with said central section top surface and a bottom surface that is spaced from said central section bottom surface, a second tab extending outwardly from a second side of said central section sides and having a top surface spaced from said central section top surface and a bottom surface that is essentially coplanar with said central section bottom surface, and an outlet socket slot engaging prong fixed at one end thereof to said central section bottom surface and extending away from said central section bottom surface

2. The safety cover defined in claim 1 wherein said body central section has a thickness dimension measured between said central section top surface and said central section bottom surface, and each of said tabs has a thickness dimension measured between said tab top surface and said tab bottom surface, said tab thickness dimensions being smaller than said body central section thickness.

3. The safety cover defined in claim 2 wherein said tab thickness is equal to one-half the body central section thickness.

4. The safety cover defined in claim 2 wherein said body central section is octagonal in peripheral shape and includes eight equal sides, each side having a length as measured between adjacent corners of said body central section.

5. The safety cover defined in claim 2 wherein each tab includes a proximal end on said body central section and a distal end spaced from said body central section, and two side edges connecting said tab distal and proximal ends together, a longitudinal centerline extending between said distal and proximal ends and located between said tab side edges.

6. The safety cover defined in claim 5 wherein said first tab longitudinal centerline is collinear with said second tab longitudinal centerline.

7. The safety cover defined in claim 6 wherein said body central section has a center, and said tab longitudinal centerlines extend through said central body section center.

8. The safety cover defined in claim 7 wherein said tab width dimensions equal the tab length dimensions and equal the length dimension of said body central section sides whereby said tabs are square in peripheral shape.

9. The safety cover defined in claim 8 wherein said tab fastener-receiving holes are each centered on the center of each of said tabs.

10. The safety cover defined in claim 2 wherein said prong is located closer to said first tab than to said second tab.

11. The safety cover defined in claim 10 wherein said body central section bottom surface includes a recessed area.

12. The safety cover defined in claim 2 further including a fastener-receiving hole defined through each of aid first and second tabs.

13. The safety cover defined in claim 12 further including a fastener element extending through at least one of said fastener receiving holes attaching said cover to a wall socket.

14. The safety cover defined in claim 13 wherein at least one of said fastener elements includes a special tool-engaging opening.

15. The safety cover defined in claim 14 wherein said special tool-engaging opening is star shaped.

16. The safety cover defined in claim 2 further including a tearline between said first tab and said body central section.

17. The safety cover defined in claim 16 further including a second tearline between said second tab and said body central section.

18. A safety cover for use on an electrical wall outlet switch comprising:

two one-piece bodies, each having a central section that includes a plurality of sides, a top surface, and a bottom surface, a first tab extending outwardly from one side of said central section sides and having a top surface that is essentially coplanar with said central section top surface and a bottom surface that is spaced from said central section bottom surface, a second tab extending outwardly from a second side of said central section sides and having a top surface spaced from said central section top surface and a bottom surface that is essentially coplanar with said central section bottom surface, and an outlet socket slot engaging prong fixed at one end thereof to said central section bottom surface and extending away from said central section bottom surface.

19. The safety cover defined in claim 18 wherein the tabs on one body extend collinearly with the tabs on the other body.

20. The safety cover defined in claim 18 wherein a first tab on one body of said bodies is coincident with a second tab on the other body.

21. The safety cover defined in claim 20 further including a fastener coupling said first tab on said one body to said second tab on said other body and to a wall socket.

22. The safety cover defined in claim 18 wherein the tabs on one body extend at an angle with respect to the tabs on the other body.

23. The safety cover defined in claim 22 wherein said angle includes a right angle.

* * * * *